US006032731A

United States Patent [19]

Grunditz

[11] Patent Number: 6,032,731

[45] Date of Patent: Mar. 7, 2000

[54] HEAT EXCHANGER

[76] Inventor: Stellan Grunditz, 11, rue d'Angleterre, Nice, France, FR-06000

[21] Appl. No.: 09/265,987

[22] Filed: Mar. 11, 1999

[30] Foreign Application Priority Data

Mar. 20, 1998 [SE] Sweden ..... 9800934

[51] Int. Cl.[7] ..... F28D 9/00; F28F 3/08

[52] U.S. Cl. ..... 165/166; 165/DIG. 382

[58] Field of Search ..... 165/166, 167, 165/DIG. 382, 165

[56] References Cited

U.S. PATENT DOCUMENTS

| | | | |
|---|---|---|---|
| 1,197,944 | 9/1916 | Munters | 165/166 |
| 5,121,792 | 6/1992 | Schukey | 165/166 |

FOREIGN PATENT DOCUMENTS

| | | | |
|---|---|---|---|
| 176221 | of 0000 | Australia | 165/166 |
| 1035399 | 8/1983 | U.S.S.R. | 165/166 |
| 1816950 | 5/1993 | U.S.S.R. | 165/166 |

*Primary Examiner*—Allen Flanigan
*Attorney, Agent, or Firm*—Dowell & Dowell, P.C.

[57] ABSTRACT

A heat exchanger for fluids such as liquids, steam, gases, etc. comprises a tank (10) with two separated closed systems for the fluids, between which heat is to be exchanged.

The tank (10) has an insert (18)consisting of longitudinally curved, preferably semicircularly shaped elements (12). The elements (12) are assembled in a sequence with their concave surfaces contacting the edges of the adjoining element. Along said edges the elements are assembled fluidtight. Between two elements (12), thus, a channel (16) is formed open to two opposite sides of the insert (18). The inlet and outlet means (20) are respectively connected to these sides, so that every second fluid channel (16) is connected to the same inlet and outlet means (20) respectively, the fluid thus being adapted to be supplied to every second channel from the corresponding inlet and outlet means.

8 Claims, 4 Drawing Sheets

Figure 6A:
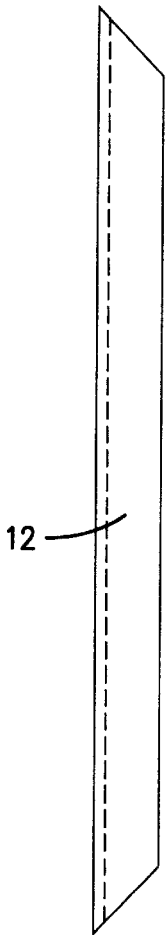
Figure 6B:
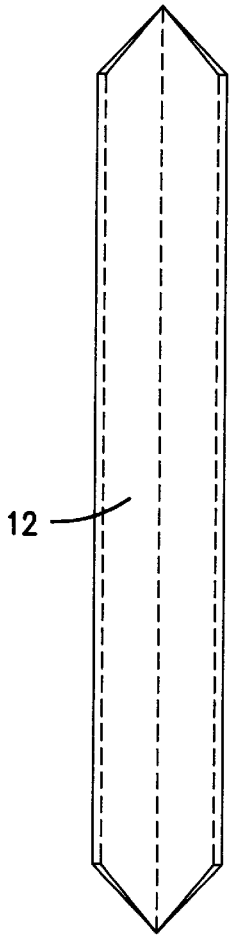

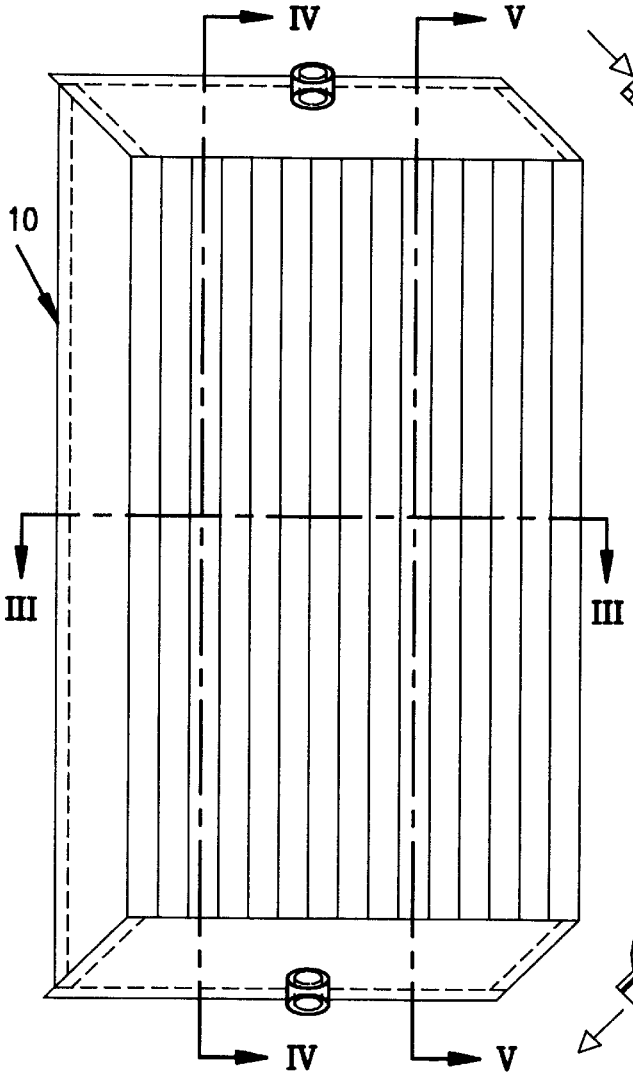
FIG. 1
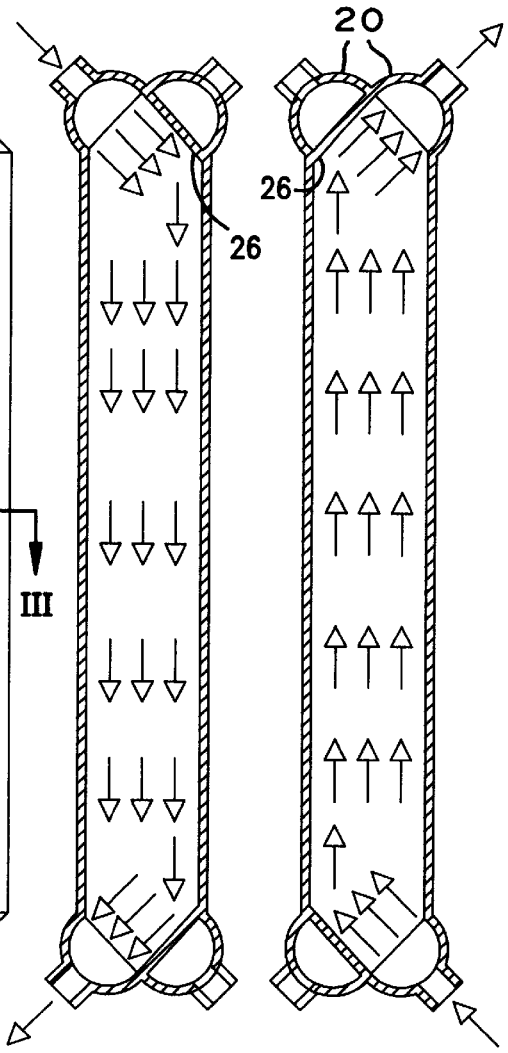
FIG. 4 FIG. 5
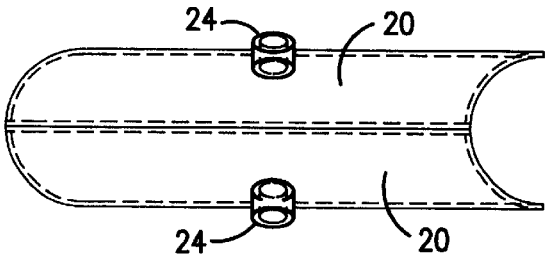
FIG. 2
FIG. 3
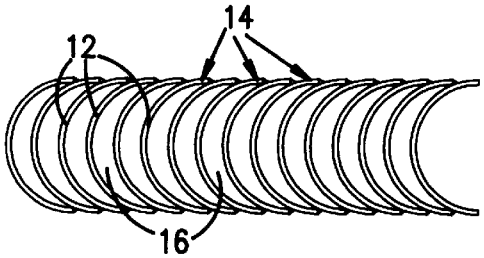

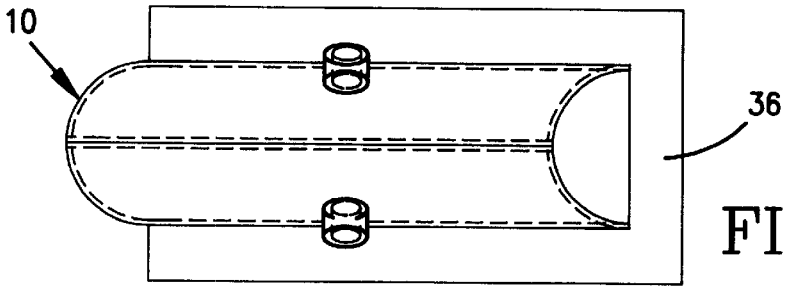
FIG. 12a
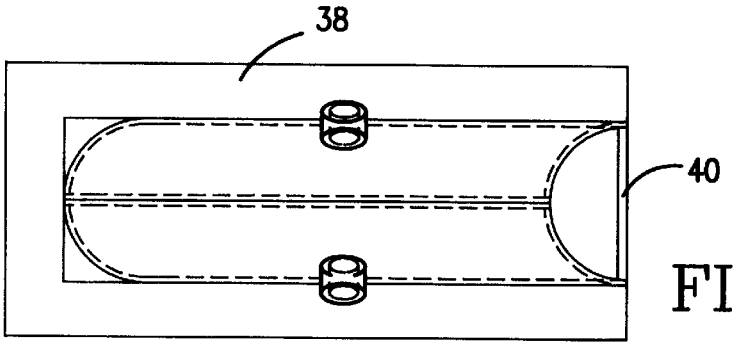
FIG. 12b
FIG. 13a
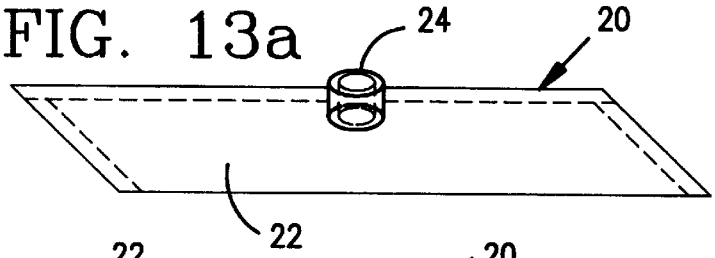
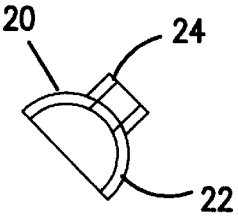
FIG. 13c
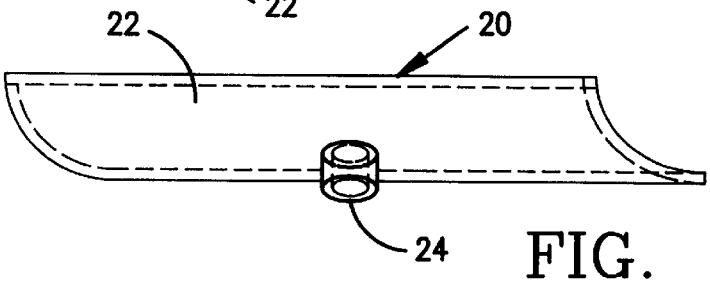
FIG. 13b
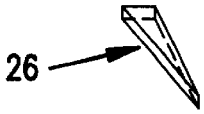
FIG. 14a
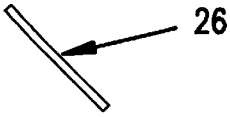
FIG. 14c
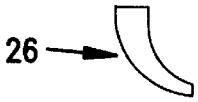
FIG. 14b

HEAT EXCHANGER

The present invention relates to a heat exchanger for fluids such as liquids, steam, gases, etc. comprising a heat exchanger tank with two separated closed systems for the fluids, between which heat is to be exchanged.

In heat exchangers known in the art, e.g. so-called tube heat exchangers, several heat exchanger bodies such as tubes are inserted into a tank in such a way, that they at their ends are sealingly connected to the tank gables, the outlet and inlet connections, respectively, to be attached to each tube.

Due to the design described above the heat exchangers known in the art become complicated and expensive in production. It is even complicated to redesign the heat exchangers for an extended capacity.

The main purpose of the present invention is to achieve a heat exchanger of the kind described in the beginning, with which the drawbacks of known exchangers are eliminated and a simple and uncomplicated design of the heat exchanger body is achieved.

Another purpose is to present a heat exchanger which is easily redesigned for an extended capacity without complicating the connection for the inlet and the outlet.

These and other objects of the invention are achieved in providing it with the characteristics specified in the claims to follow.

The invention will be described here below in connection with the embodiments shown in the drawings.

Figure 7:
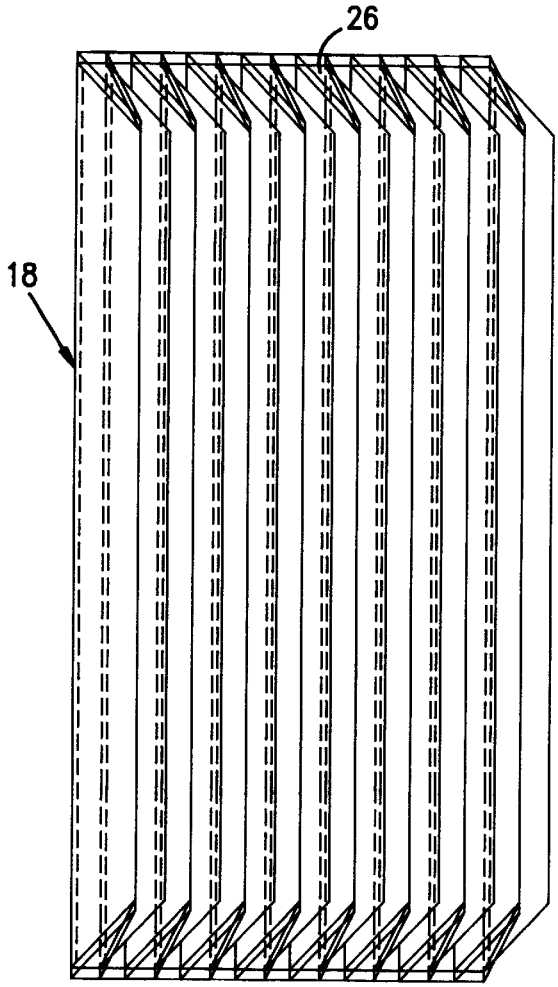
Figure 6C:
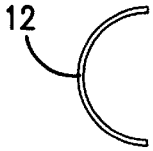
Figure 8:
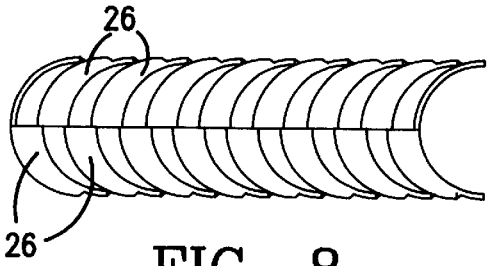
Figure 9:
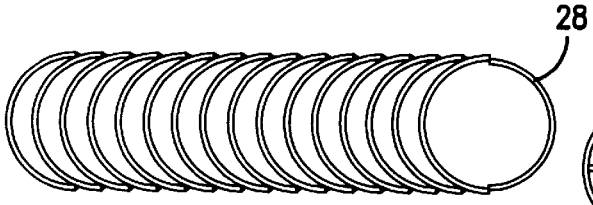
Figure 10:
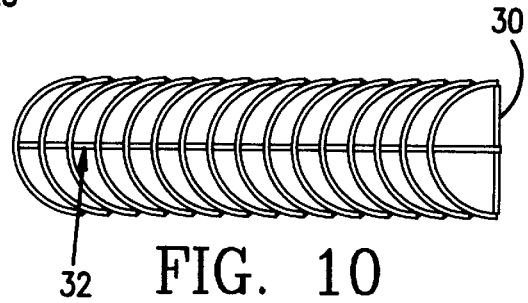
Figure 11A:
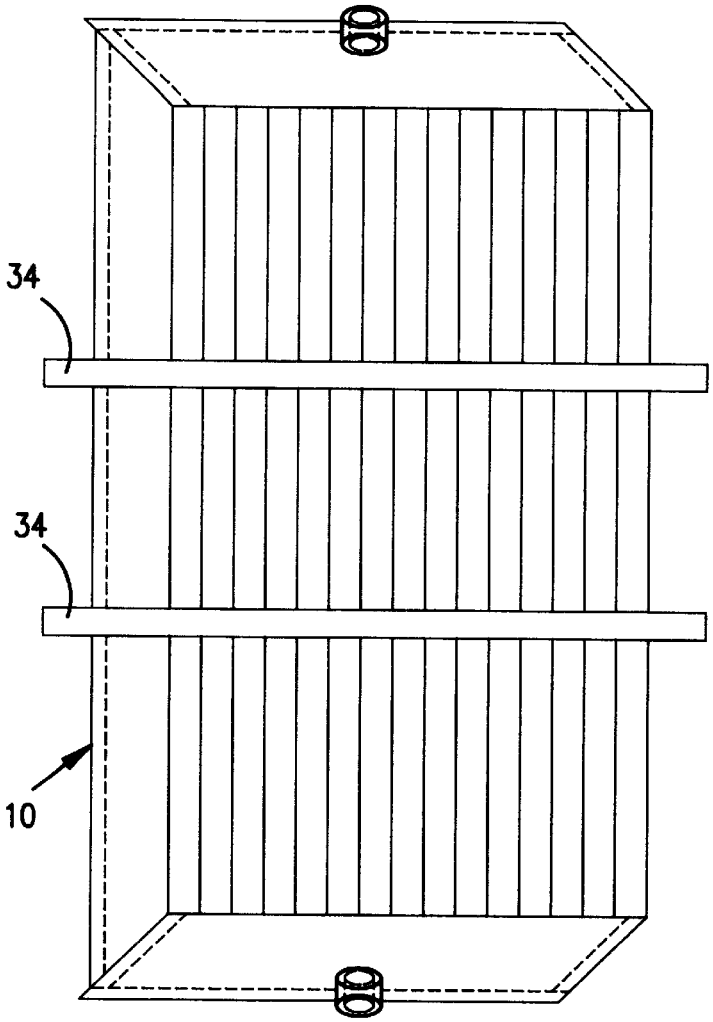
Figure 11B:
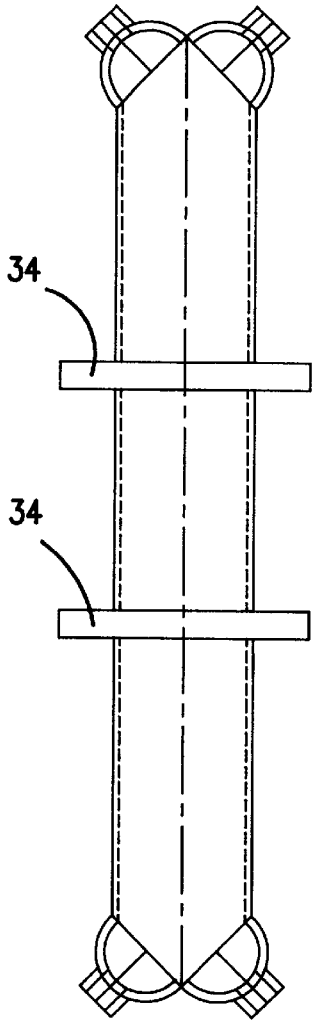
Figure 11C:
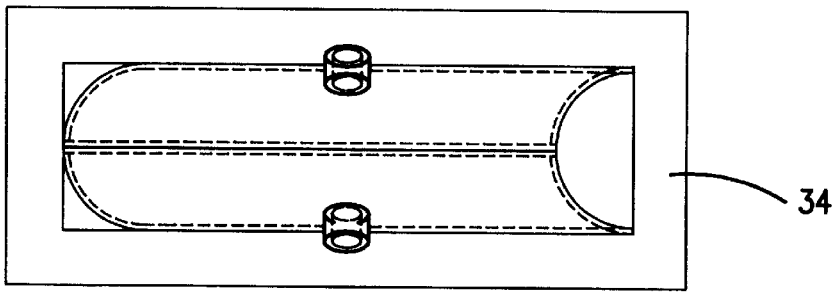

FIG. 1 shows a front view of a heat exchanger designed according to the invention, FIG. 2 shows a top view of a heat exchanger according to FIG. 1, FIG. 3 shows a cross section along the line III—III of the heat exchanger in FIG. 1, FIG. 4 shows a cross section along the line IV—IV of the heat exchanger in FIG. 1, FIG. 5 shows a cross section along the line V—V of the heat exchanger in FIG. 1, FIGS. 6*a* to 6*c* show a side view, a top view and a front view, respectively, of a half tube of which the heat exchanger is composed, FIG. 7 shows a front view of several joint tube parts constituting the heat exchanger body, FIG. 8 shows a top view of the heat exchanger body in FIG. 7, FIGS. 9 and 10, respectively, show cross sections similar to FIG. 3 of alternative embodiments of the exchanger body, FIGS. 11*a*, 11*b* and 11*c* show a front view, a side view and top view, respectively, of a heat exchanger with reinforcements, FIGS. 12*a* and 12*b* show top views similar to FIG. 11*c* of alternative embodiments of the reinforcement, FIGS. 13*a* to 13*c* show a side view, a top view and a front view, respectively, of the inlet and the outlet box for the heat exchanger in FIG. 1, and FIGS. 14*a* to 14*c* show a side view, a top view and a front view, respectively, of a covering plate to cover the channel openings in the heat exchanger body.

The heat exchanger shown in FIG. 1 comprises a tank 10 composed of several curved elements, e.g. slotted tube parts 12, in the shown embodiment preferably half tubes, with their concave surfaces inserted into each other in accordance with FIG. 3 and fluidtightly assembled along their longitudinal edges 14. Between two adjoining elements 12 a channel 16 is formed running from one end of the tank 10 to the other, in the shown case between the upper and the lower end of the heat exchanger tank 10. Each element 12 is in accordance with FIGS. 6*a* to 6*c* at its ends symmetrically and conically bevelled in a V-shape so that the heat exchanger body or insert 18, as shown in FIG. 7, obtains bevelled or angled end surfaces. On these angled end surfaces inlet and outlet boxes 20, respectively, are provided, in the shown example consisting of a semicircular mantle 22 being in accordance with FIGS. 13*a* to 13*c* open downwards, but closed at its end surfaces. On the mantle 22 is e.g. centrally provided a bound 24 adapted to connect supply means, such as ducts or similar (here not shown) for the supply of the fluids, between which the heat exchange has to occur. The inlet box 20 covers in accordance with FIGS. 4 and 5 one of the angled surfaces of the assembled tubular elements 12 at their upper and lower ends. For the supply and the disposal in the same box 20 of only one of the fluids passing each second channel 16 in the heat exchanger insert 18, respectively, covering washer 26 are arranged over half the width of each channel 16, in accordance with FIG. 8, in such a way, that the washers 26 alternate between both longsides of the exchanger body's 18 angled end surfaces. The design of the covering washers is shown in FIGS. 14*a* to 14*c*.

In accordance with FIGS. 2 and 3 the exchanger insert 18 terminates at one end of a tubular element, in the shown example a half tube, which eventually can be sealed by means of a plane end plate (here not shown). Alternatively, the insert can in accordance with FIG. 9 terminate with a complete tube 28, or, as shown in FIG. 10, with a T-shaped angled plate 30, extending along the exchanger body's 10 height. The angled plate's waist provides a reinforcement of the insert 18 for a higher pressure resistance, and for increasing the strength of the body and the insert 18 further in this respect plane reinforcement plates 32 are also arranged between the tube elements 12 as also shown in FIG. 10. For a further reinforcement of the heat exchanger 10 reinforcement means, e.g. two flanges 34 shown in figures 11*a* to 11*c*, might be provided. The flanges 34 can then circumcize the complete heat exchanger, as shown in FIGS. 11*a* to 11*c*, and consist of one or several flanges 36 arranged around three sides of the exchanger 10, as shown in FIG. 12*a*, or one or several flanges 38 arranged around three sides of the exchanger and on one side supplemented by a cross bar 40, shown in FIG. 12*b*.

As is evident from what has been described above, a heat exchanger according to the invention is provided having a simple and uncomplicated structure enabling a production of larger or smaller heat exchangers by means of simply adding the required number of elements 12. The heat exchanger 10 can be of any material whatsoever suitable for the application in question, such as metal, e.g. stainless, acid resistant steel or plastics and the fluidtight connections are achieved by means of welding, glueing or any other joining technique suitable for the application. The example in FIGS. 2 and 3 showsthat one medium is supplied at the exchanger upper side and is deducted at the bottom, whereas the other medium is supplied from beneath and deducted at the exchanger top so that the heat exchange is provided in contraflow. By a corresponding arrangement of the inlet and outlet boxes 20, respectively, in combination with arranging the covering washers 26 other possibilities might of course be endeavoured, e.g. so that the media are supplied at one side and are deducted at the opposite side of the heat exchanger. The reinforcements 32 shown between the insert elements 12 can be designed in many ways and even other shapes of inserts might be arranged in the channels 16 for e.g. influencing the fluid flow.

Evidently, the embodiments shown and described are merely examples of the invention and it can be accomplished in various ways within the scope of the claims to follow.

I claim:

1. A heat exchanger for fluids such as liquids, steam, gases, etc. comprising a heat exchanger tank with two separated closed systems for the fluids, between which heat is to be exchanged, characterized in that the tank consists of longitudinal, curved, generally semicircular elements (12) in section, assembled with their convex surfaces contacting the longitudinal edges of the nearest element and fluidtightly connected or assembled along said contact surface along the complete element, that a fluid channel being open at two opposite sides of the tank is provided between each pair of elements, said sides being provided with inlet and outlet means (20), respectively, connnected with the tank so that every second fluid channel is connected with the same inlet and outlet means (20).

2. A heat exchanger according to claim 1, characterized in that the elements (12) are chamfered angularly at their opposite ends so the the tank ends obtain a V-shape, an open box (20) being provided over each surface of the V-shape and open towards said surface, with a connection (24) for the supply of a fluid to the box and every second channel (16) under the box being closed, so that the fluid might be supplied only to the nonclosed channels from the box.

3. A heat exchanger according to claim 1, characterized in that the elements (12) consist of half tubes obtained by symmetrically and longitudinally splitting a complete tube.

4. A heat exchanger according to claim 1, characterized in that a reinforcing border (32) is inserted between each pair of elements (12) and runs along the complete element length.

5. A heat exchanger according to claim 4, characterized in that a T-shaped reinforcement plate (30) is inserted in the last element (12) open to the outside, the flanges of said plate covering said element opening.

6. A heat exchanger according to the claim 1, characterized in that said last element (12) in an assembled line of elements consists of a complete tube (30).

7. A heat exchanger according to the claim 1, characterized in that one or several reinforcement flanges (34; 36; 38) are provided around the outside of the heat exchanger tank, said flanges enclosing the tank completely or partly.

8. A heat exchanger according to the claim 1, characterized in that the inlet and outlet boxes (20), respectively, for both fluids are arranged so that the fluids are supplied in contraflow through the heat exchanger (10).

* * * * *